US006512903B2

(12) United States Patent
Chadani

(10) Patent No.: US 6,512,903 B2
(45) **Date of Patent: *Jan. 28, 2003**

(54) DEVELOPER ACCOMMODATING CONTAINER, A DEVELOPING DEVICE, A PROCESS CARTRIDGE, AND AN IMAGE FORMING APPARATUS WHOSE DEVELOPER-ACCOMMODATING-CONTAINER OPENING IS SEALED BY A SEAL MEMBER

(75) Inventor: Kazuo Chadani, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/501,632

(22) Filed: Feb. 10, 2000

(65) Prior Publication Data

US 2002/0012546 A1 Jan. 31, 2002

(30) Foreign Application Priority Data

Feb. 16, 1999 (JP) ..... 11-037188

(51) Int. Cl.[7] ..... G03G 15/08

(52) U.S. Cl. ..... 399/106; 399/258; 399/262

(58) Field of Search ..... 222/DIG. 1; 399/12, 399/13, 25, 27, 102, 103, 105, 106, 111, 258, 262, 263

(56) References Cited

U.S. PATENT DOCUMENTS 5,943,529 A 8/1999 Miyabe et al. ..... 399/111
5,966,567 A 10/1999 Matsuzaki et al. ..... 399/111

FOREIGN PATENT DOCUMENTS

JP 9-114352 * 5/1997

* cited by examiner

*Primary Examiner*—Hoang Ngo
(74) *Attorney, Agent, or Firm*—Fitzpatrick, Cella, Harper & Scinto

(57) ABSTRACT

A developer accommodating container for accommodating a developer and being detachably mountable to a main assembly of an image forming apparatus includes a main body for accommodating the developer, having an opening for supplying the developer; an unsealable seal member for sealing the opening, and a drive transmitter for transmitting a driving force from the main assembly of the apparatus to apply a force for unsealing the seal member. The drive transmitter transmits the driving force to a movable member which is movable and in contact with the developer after completion of an unsealing operation for the sealing member.

60 Claims, 10 Drawing Sheets

DEVELOPER ACCOMMODATING CONTAINER, A DEVELOPING DEVICE, A PROCESS CARTRIDGE, AND AN IMAGE FORMING APPARATUS WHOSE DEVELOPER-ACCOMMODATING-CONTAINER OPENING IS SEALED BY A SEAL MEMBER

FIELD OF THE INVENTION AND RELATED ART

The present invention relates to a developer container for storing developer, a developing apparatus, a process cartridge, and an image forming apparatus.

Conventionally, an electrophotographic image forming apparatus such as a copying machine or a printer is provided with a container for storing developer. This type of container is provided with an opening through which developer is discharged into a developing device. However, in order to prevent toner from leaking out of the container while a container filled with developer is transferred, the opening is covered with a seal, which is removed by a user after the installation of the container into the main assembly of an image forming apparatus. A developer container may be an integral part of a developing apparatus, or may be an integral part of a process cartridge, which is removably installable in an image forming apparatus, and integrally comprises a photosensitive member as an image bearing member, and a developing apparatus equipped with a developer container and a developing device. In the case of the latter, the opening between the developer container and developing device in a brand-new process cartridge, through which developer is to be delivered from the developer container to the developing device, is covered with a sealing member, which is removed after the process cartridge is installed into an image forming apparatus.

However, it has been desired that the aforementioned sealing member be automatically removed, instead of being removed by a user, to improve operational efficiency.

In order to automatically remove the sealing member, a sealing member removing member for automatically taking up, or winding away, the sealing member, and a means for transmitting a driving force from the driving power source on the image forming apparatus main assembly side to the sealing member removing member, were necessary.

Further, in order to convey or stir the developer in the developer container or the developing apparatus, a rotational member as a developer moving member, which moves the developer by making contact with the developer, is disposed within the developer container or the developing apparatus. In order to transmit a driving force to this rotational member, another driving force transmitting member is provided to transmit the driving force from the driving force source of the image forming apparatus main assembly.

In the past, the driving of the means for transmitting the driving force to the sealing member winding member was stopped as soon as the winding of the sealing member was completed, or interrupted, and therefore, a dedicated means for transmitting the driving force to the sealing member winding member was necessary. Also, in many conventional image forming apparatuses, the operation for winding the sealing member and the operation for driving the rotational member were carried out at the same time.

Such structural arrangements complicate the driving means of the conventional image forming apparatuses. In addition, opening the sealing member at the same time as the rotational member was rotated resulted in an increase in power consumption.

SUMMARY OF THE INVENTION

The primary object of the present invention is to provide a developer container, a developing apparatus, a process cartridge, and an image forming apparatus that are simple in the structure for transmitting a driving force from the image forming apparatus main assembly to the above components.

Another object of the present invention is to provide a developer container, a developing apparatus, a process cartridge, and an image forming apparatus, that do not open the toner sealing member at the same time as the member that moves the developer by making contact with the developer is driven.

Another object of the present invention is to provide a developer container, a developing apparatus, a process cartridge, and an image forming apparatus that decrease the power consumed by the image forming apparatus main assembly.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

An embodiment of the present invention will be described with reference to FIGS. 1 and 2.

(Description of Process Cartridge and Main Assembly of Image Forming Apparatus)

Figure 1:
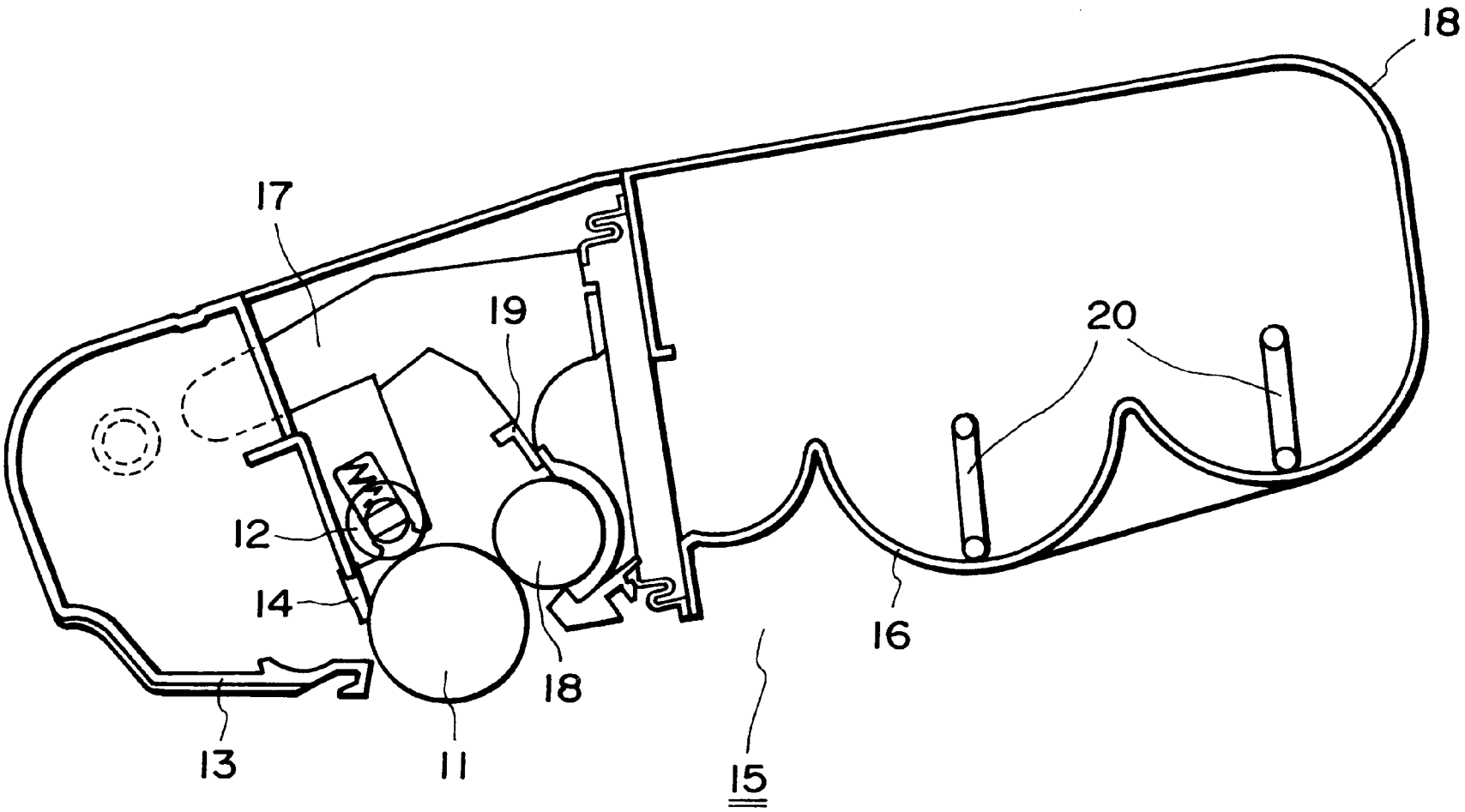
FIG. 1 is a schematic cross sectional view of a process cartridge in the first embodiment of the present invention.
Figure 2:
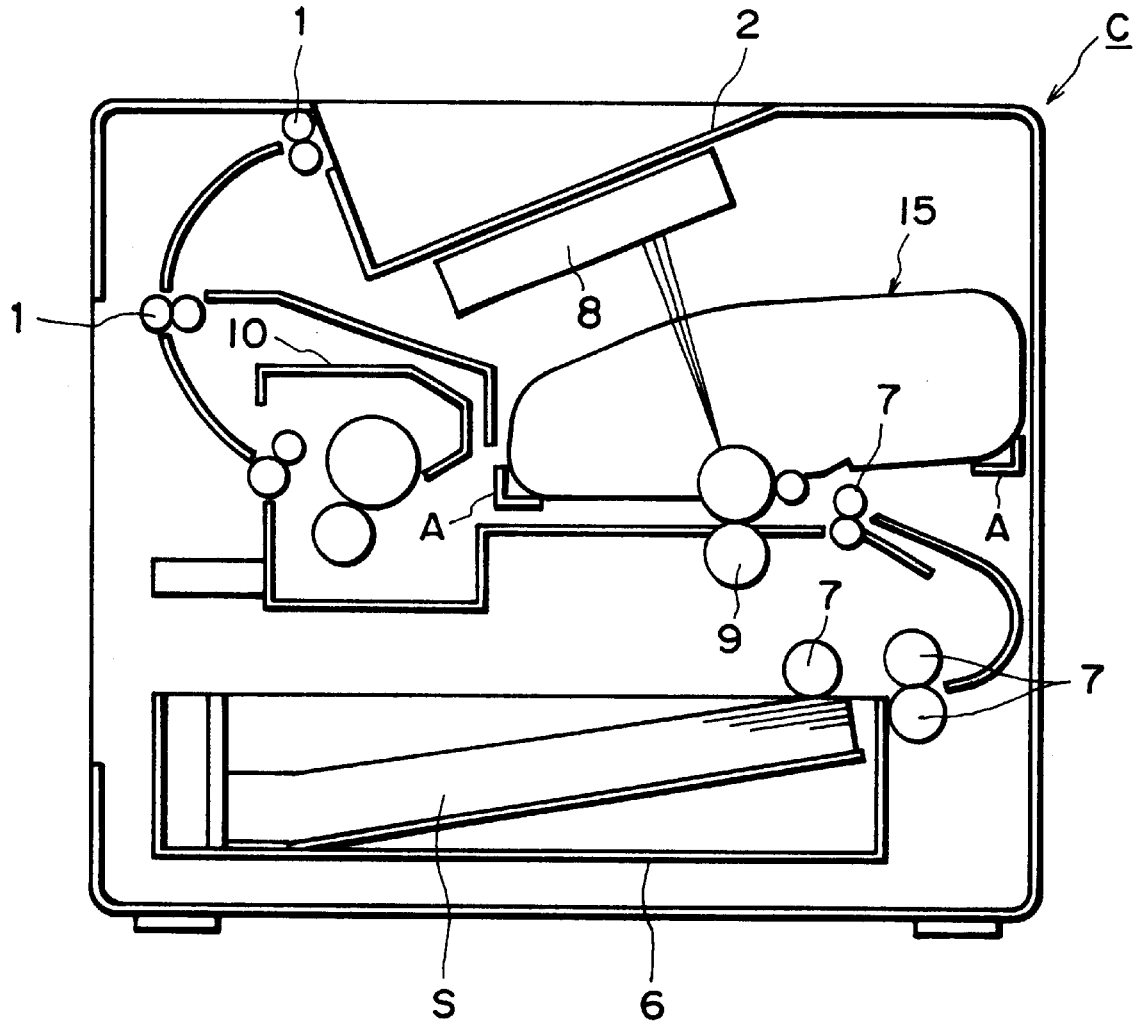
FIG. 2 is a schematic cross sectional view of the main assembly of an image forming apparatus in accordance with the present invention.

FIG. 1 is a schematic cross sectional view of the essential portion of a process cartridge in accordance with the present invention, and FIG. 2 is a schematic cross sectional view of the essential portion of an image forming apparatus in accordance with the present invention. This process cartridge is removably installable in the main assembly A of this image forming apparatus, and comprises an image bearing member, and one or a plurality of processing means which work on the image bearing member. As for the processing means, there are a charging means for charging the surface of the image bearing member, a developing apparatus for forming a toner image on the image bearing member, and a cleaning means for removing the toner particles remaining on the surface of the image bearing member, for example. The process cartridge has only to comprise a minimum of one processing means.

As shown in FIG. 1, the process cartridge 15 in this embodiment comprises: an electrophotographic photosensitive member as an image bearing member; a charge roller 12 as a charging means; a developing apparatus which comprises a development sleeve 18 as a developer bearing member, and a development blade 19; a toner containing portion 16 as a developer container; a stirring member 20 as a rotational member (moving member) for stirring the toner within the toner storing frame; and a cleaning blade 14 as a cleaning means. These components are integrally disposed within the cartridge housing, in a manner to surround the peripheral surface of the electrophotographic photosensitive member 11, forming a process cartridge 15 which is removably installable within the main assembly of an image forming apparatus.

Next, referring to FIG. 2, the process cartridge 15 is installed in the process cartridge space A of the image forming apparatus to be used for an image forming process, in which an image is formed on a sheet S conveyed from a sheet cassette 6, located in the bottom portion of the image forming apparatus main assembly, to the transfer position of the photosensitive drum 11, by a conveyer roller 7.

The photosensitive drum 11 is charged by the charge roller 12, across its peripheral surface, and the charged surface is selectively exposed by an exposing apparatus 8 in accordance with image formation data. As a result, an electrostatic latent image is formed. The exposing process by the exposing apparatus 8 is carried out in synchronism with the sheet conveyance by a registration roller.

Thereafter, the toner stored in the toner containing portion 16 is sent to the development chamber 17 through the opening. In the development chamber 17, the toner is placed in a thin layer on the peripheral surface of the development roller 18 by the development blade 19. The toner is transferred onto the peripheral surface of the photosensitive drum 1 from the thin layer of toner on the development roller 18 in accordance with the latent image, by applying development bias to the development roller 18. As a result, a toner image is formed on the photosensitive drum 11. Then, the toner image on the photosensitive drum 11 is transferred onto the sheet S by applying bias, i.e., voltage, to the transfer roller 9, as the sheet S is passed through the transfer position. Then, the sheet S is conveyed to a fixing apparatus 10, in which the toner image is fixed to the sheet S. Finally, the sheet S is discharged by a discharge roller 1, into a delivery portion 2 located at the top of the image forming apparatus main assembly.

Description of Opening of Toner Seal and Driving of Stirring Member

Figure 3:
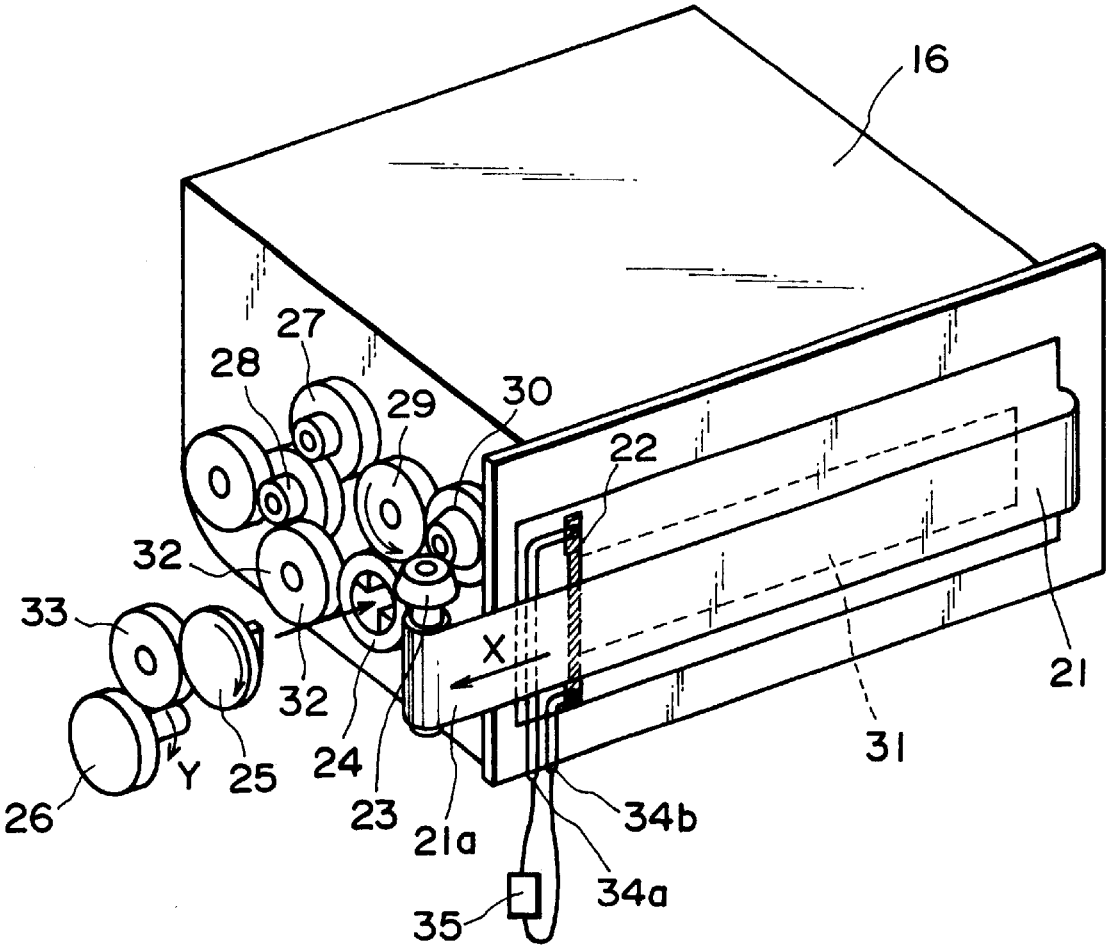
FIG. 3 is a schematic perspective view of the toner container of the process cartridge which has never been used, in the first embodiment.
Figure 4:
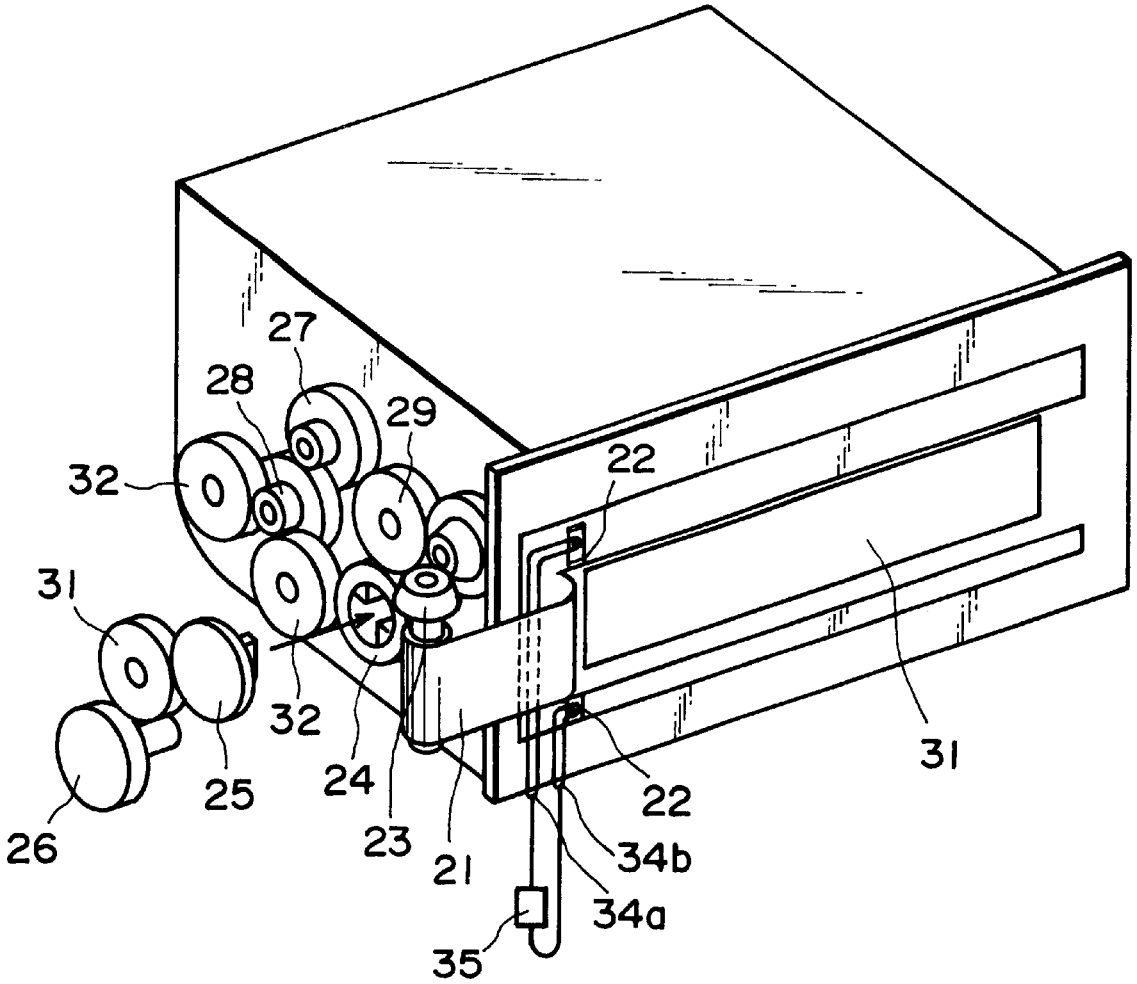
FIG. 4 is a schematic perspective view of the toner container of the process cartridge in the first embodiment, after the toner sealing member has been removed by winding.
Figure 5:
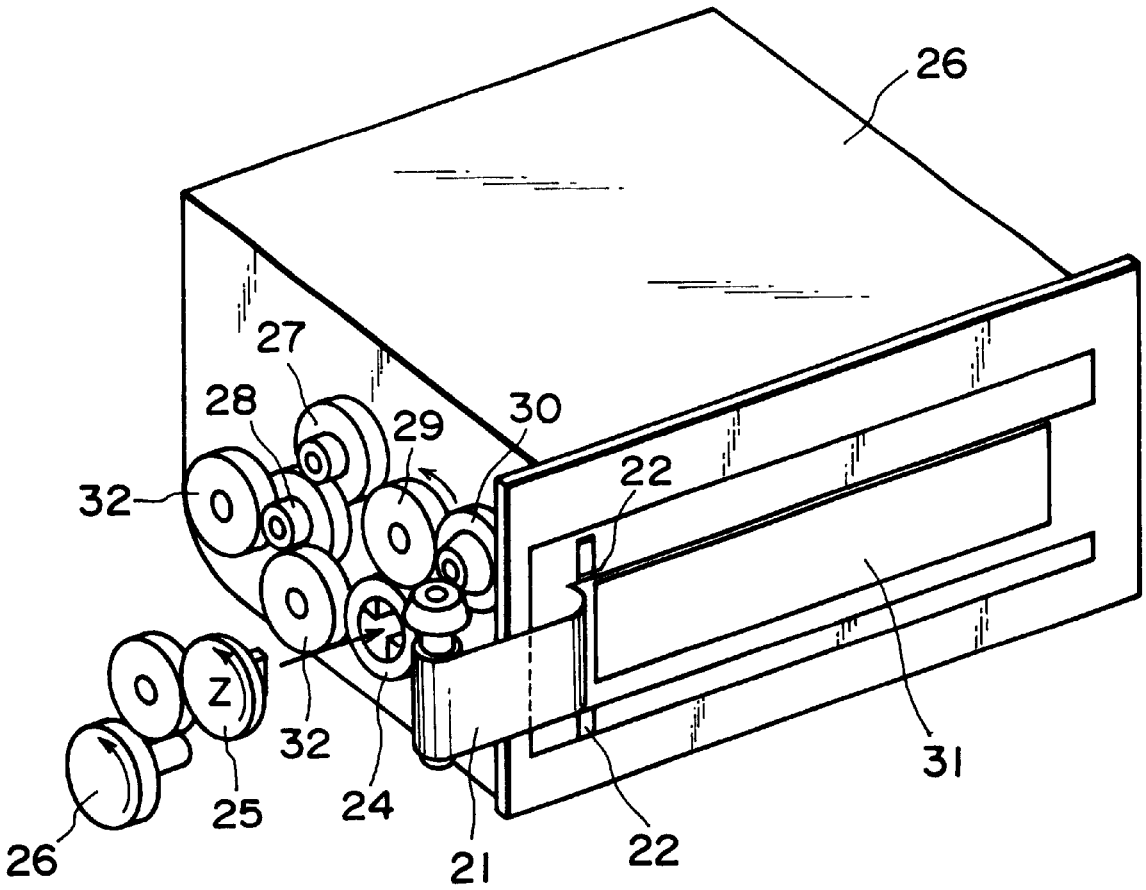
FIG. 5 is a schematic perspective view of the toner container of the process cartridge in the first embodiment, when the stirring member is being rotated.

FIGS. 3–5 are drawings for describing the toner containing portion; they illustrate only the developer storing container portion of the process cartridge. The opening 31 of the toner containing portion 16 of a brand-new process cartridge is covered with a toner sealing member, which is welded or pasted to the toner containing portion 16 in such a way as to cover, or seal, the opening 31. The toner sealing member 21 is doubled over so that one end 21*a* of the toner sealing member 21 is fixed to the rotational take-up, or winding member 23 attached to the toner containing portion 16.

The toner sealing member 21, which comprises a polyethylene-terephthalate sheet, that is, an electrically non-conductive sheet, is provided with a signaling portion 22, the detection of which by the image forming apparatus main assembly side confirms that the aforementioned opening 31 has been completely exposed. In this embodiment, the signaling portion 22 is an electrically conductive strip, and more specifically, a piece of aluminum foil adhered to the sealing member 21, across the portion of the container immediately adjacent to the last portion of the opening to be exposed. To this electrically conductive strip, voltage is applied from the detecting portion 35 of the image forming apparatus main assembly through a metallic plate on the process cartridge side, which is provided with contact points 34*a* and 34*b*.

As a brand-new process cartridge is installed into the image forming apparatus main assembly, the detecting portion 35 and electrically conductive strip 22 are electrically connected through the contact points 34*a* and 34*b*. In other words, before the toner sealing member 23 is wound away, a predetermined amount of electrical current flows through the electrically conductive strip 22, and this current is detected by the detecting portion 35 on the image forming apparatus main assembly side. As the current is detected, a motor 26 as a source of mechanical driving force, with which the image forming apparatus main assembly is provided, begins to be driven in the direction indicated by an arrow mark Y. The driving force generated by the motor 26 is transmitted to a coupling 25 through idler gear 33, on the image forming apparatus main assembly side. Then, the driving force is transmitted from the coupling 25 to a coupling gear 24, with which the process cartridge is provided, and by which a pivotal gear 29 is driven. Next, as the pivotal gear 29 is pivoted by the rotational force from the coupling gear 24, the pivotal gear 29 engages with an idler gear 30, transmitting the driving force to the idler gear 30, which in turn rotates the gear of the toner sealing member winding member meshed with the idler gear 30. As the gear of the winding member 23 rotates, the toner sealing member 21 is wound away in the direction indicated by an arrow mark X. During this process, the pivotal gear 29 remains separated from a pivotal idler gear 27; the former is not meshed with the latter.

Next, referring to FIG. 4, as the opening 31 is completely exposed, the electrically conductive strip 22 is severed, interrupting the electrical current flow. As this interruption of the electrical current is detected by the detecting portion 35 of the image forming apparatus main assembly, the motor 26, which was rotating in the direction to generate the driving force to be transmitted to the coupling for driving the winding member 23 of the image forming apparatus, begins to rotate in reverse. As a result, the coupling 25 of the image forming apparatus begins to rotate in reverse, that is, in the direction indicated by an arrow mark Z in FIG. 5, causing the coupling 24 of the process cartridge to rotate in reverse. With this reverse rotation of the coupling 24, the pivotal gear 29 is separated, that is, disengaged, from the idler gear 30, and is engaged with a pivotal idler gear 27 to rotate the pivotal idler gear 27, which transmits the driving force to a stirring gear 32 through an idler gear 28. The stirring gear 32 rotates the stirring member 20 in the toner storing shell illustrated in FIG. 1.

The detecting portion 35 is provided with a DC power source and a current monitor. Whether or not the sealing member has been opened is detected as the electrical current flowed by the application of voltage by the power source is measured by the monitor.

Figure 6:
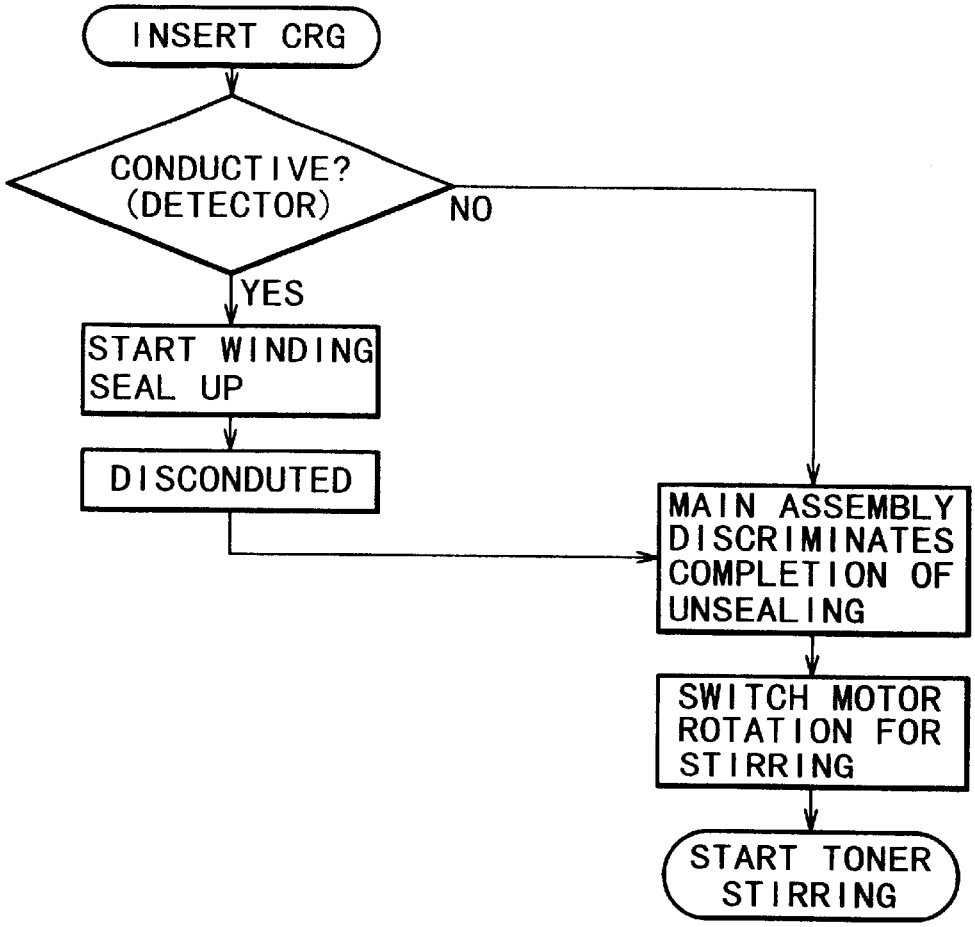
FIG. 6 is a flow chart for the first embodiment.
Figure 7:
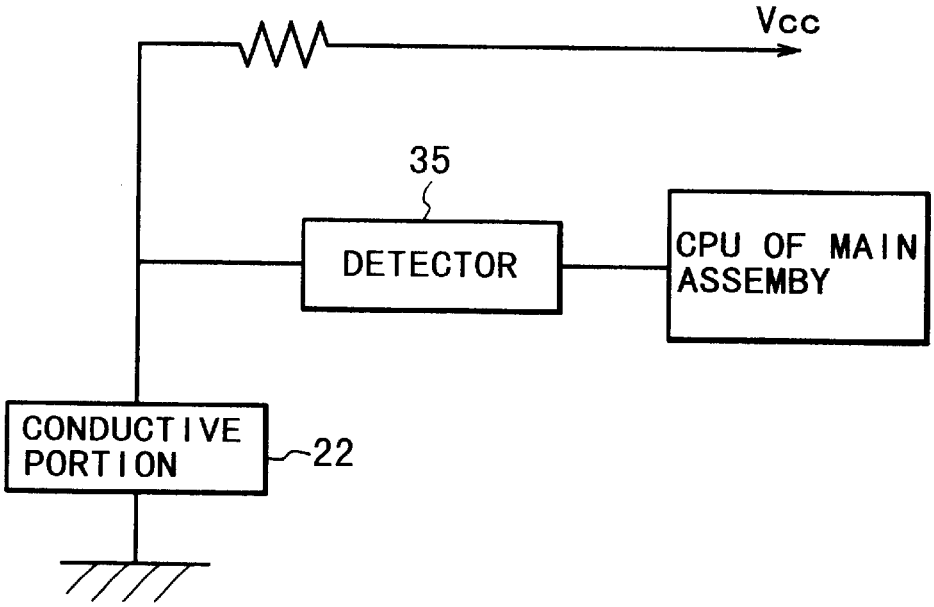
FIG. 7 is a simplified version of the circuit diagram for the first embodiment.

The above described processes can be summarized in the form of a flow chart given in FIG. 6, and a simplified version of the electrical circuit diagram related to the processes is given in FIG. 7.

In this embodiment, after the installation of the process cartridge in accordance with the present invention into the image forming apparatus, it is confirmed whether or not electrical current is flowing through the electrically conductive strip. If the current is flowing, the winding-up of the sealing member is started, and is continued until the electrically conductive strip is severed by the progress of the unsealing operation. Then, as the electrically conductive strip is severed, it is determined that the removal of the sealing member has been completed, and the motor within the main assembly of the image forming apparatus begins to be rotated in reverse to start rotating the toner stirring member.

The main assembly of the image forming apparatus in this embodiment stores various pieces of information regarding the state of the usage of the process cartridge 15 which is in the image forming apparatus main assembly, for example, the number of revolutions of the photosensitive drum 11, the number of the recording medium sheets S passed through the apparatus, and the printing ratio. It is also provided with a displaying means (unillustrated) for informing users of the remaining life and present state of the process cartridge 15. The means for predicting the remaining life of the process cartridge 15 predicts the remaining life of the process cartridge 15 by counting the number of developed picture elements, and calculating the consumed amount of the toner, from which the remaining life of the process cartridge 15 is predicted.

If it is determined by the aforementioned structure for detecting the presence or absence of the toner sealing member, that the process cartridge 15 is not a brand-new one, this means that the toner sealing member has been wound away, in other words, the process cartridge has been in use. In such a case, the information regarding the state of the usage of the process cartridge 15 is continuously accumulated as the information regarding the process cartridge 15 which is currently in the image forming apparatus main assembly. On the other hand, if it is determined that the process cartridge 15 is a brand-new one, that is, a process cartridge with a toner seal yet to be wound away, the information regarding the state of the usage of the process cartridge 15 is reset, and a fresh set of information regarding the brand-new process cartridge 15 begins to be accumulated.

Therefore, it is possible to clearly differentiate the removal and reinstallation of the process cartridge 15, which occur when dealing with a paper jam, from the removal and reinstallation of the process cartridge, which occur when replacing a process cartridge 15, the life of which has expired, with a brand-new process cartridge 15, by detecting whether or not the toner sealing member has been removed, that is, whether or not electrical current is flowing through the electrically conductive strip. Thus, users can accurately know the remaining life of the process cartridge 15 in the image forming apparatus main assembly, and therefore, can know the accurate timing for replacing the process cartridge 15.

Embodiment 2

Figure 8:
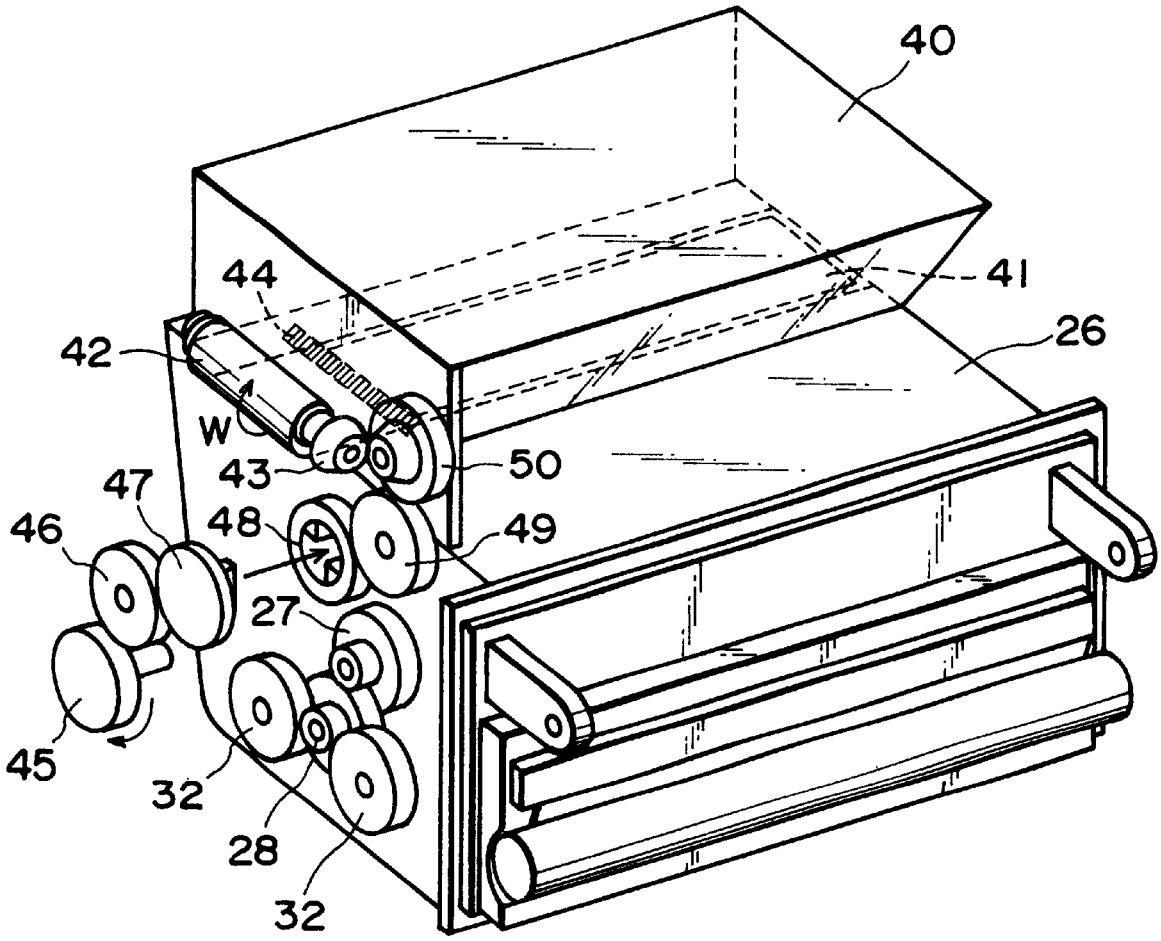
FIG. 8 is a schematic perspective view of the toner container and replenishment toner container in the second embodiment of the present invention.

In this embodiment, instead of the toner containing portion of the process cartridge in the first embodiment, a replenishment toner container is provided as a developer storing container removably installable in the image forming apparatus main assembly. FIG. 8 is a perspective view of a developing device 26, with which the image forming apparatus main assembly is provided, and a replenishment toner container 40 which has been mounted on the developing device 26.

Description of Opening of Toner Sealing Member and Stirring Drive

The opening 41 of a brand-new replenishment toner container 40 is covered with a toner sealing member 42, which is welded or pasted to the replenishment toner container 40 in such a way as to cover the opening 41. The toner sealing member 42 is doubled over so that one end of the toner sealing member 42 is fixed to the toner sealing member winding member 43 attached to the replenishment toner container 40. The toner sealing member 42 is provided with a signaling portion 44, the detection of which by the image forming apparatus main assembly side confirms that the aforementioned opening 41 is completely exposed. In this embodiment, the signaling portion 44 is an electrically conductive strip, more specifically, a piece of aluminum foil adhered to the sealing member 42, across the portion of the container immediately adjacent to the last portion of the opening to be exposed. To this electrically conductive strip, voltage is applied from the detecting portion 35 of the image forming apparatus main assembly, as in the case of the first embodiment.

As a brand-new replenishment toner container 40 is installed into the image forming apparatus main assembly, a motor 46, with which the image forming apparatus main assembly is provided, begins its driving action. The driving force generated by the motor 45 is transmitted to a coupling 47 through an idler gear 46, on the image forming apparatus main assembly side. Then, the driving force is transmitted from the coupling 47 to a coupling gear 48, with which the developer container 26 on the image forming apparatus main assembly side is provided, and by which a pivotal gear 49 on the image forming apparatus main assembly side is driven. Next, as the pivotal gear 49 is pivoted by the rotational force from the coupling gear 48, the pivotal gear 49 engages with an idler gear 50, transmitting the driving force to the idler gear 30, which in turn rotates the gear of the toner sealing member winding member 43 meshed with the idler gear 50. As the gear of the toner sealing member winding member 43 rotates, the toner sealing member 42 is wound away in the direction indicated by an arrow mark W.

Next, as the opening 41 is completely exposed, the electrically conductive strip 44 is severed, interrupting the electrical current flow. As this interruption of the electrical current is detected by the detecting portion of the image forming apparatus main assembly, the motor 45, which was generating the driving force transmitted to the coupling for driving the toner sealing member winding member 43, rotates in reverse. As a result, the coupling 47 of the image forming apparatus begins to rotate in reverse, causing the coupling gear 48 of the developer container 26 to begin rotating in reverse. With this reverse rotation of the coupling gear 48, the pivotal gear 49 is engaged with an idler gear 27 to rotate the idler gear 27, which transmits the driving force to a stirring gear 32 through an idler gear 28. The stirring gear 32 rotates the stirring member in the developer container 26. The toner within the replenishment toner container 40 is supplied into the developer container 26 through the opening 41.

In the case of the first embodiment, the process cartridge comprising the developer container was removably installable in the image forming apparatus main assembly, whereas in the case of the second embodiment, the replenishment toner container itself is removably installable in the image forming apparatus main assembly. However, an image forming apparatus may be structured so that a developing apparatus comprising a developer container and a development device, more specifically, a developing apparatus comprising the replenishment toner container 40 and development device illustrated in FIG. 8, can be removably installed.

Embodiment 3

In this embodiment, the sealing member is provided with another signaling portion, or the second signaling portion, in addition to the signaling portion, or the first signaling portion, with which the sealing members in the first and second embodiments were provided. This second signaling portion is an installation completion signaling portion which signals that the replenishment toner container is at the correct position in the image forming apparatus main assembly. The toner sealing member structure, the electrically conductive portion, and the like, are the same as those in the first and second embodiments.

Figure 9:
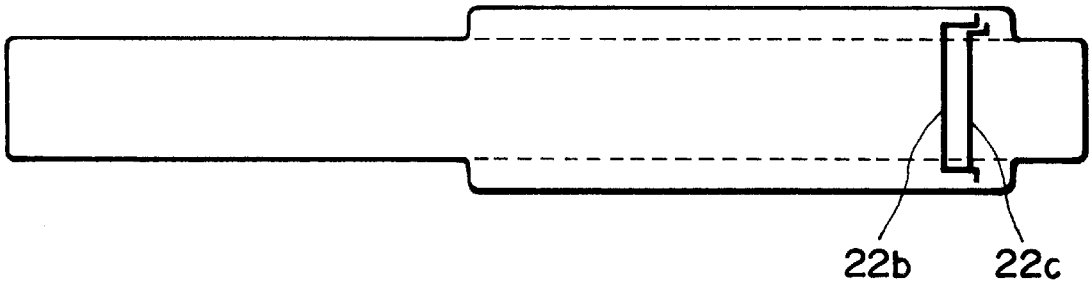
FIG. 9 is a plan view of the sealing member in the third embodiment of the present invention.

The sealing member in this embodiment is depicted in FIG. 9. In the electrically conductive portion 22 in FIG. 9, the electrically conductive strip 22*b*, which is on the inward side of the container, is the strip which signals the completion of the opening of the sealing member, and the electrically conductive strip 22*c*, which is on the outward side, is the strip which signals the completion of the installation of the container. In other words, the strip on the upstream side in terms of the direction in which the sealing member is opened is the toner sealing member opening completion signaling strip 22*b*, and the strip on the downstream side is the toner container installation completion signaling strip 22*c*.

In this embodiment, two strips of electrically conductive material were disposed across the sealing member in the same direction as the single strip of electrically conductive material was disposed across the sealing member in the first and second embodiments, that is, in the direction perpendicular to the direction in which the toner sealing member is opened. As for the contact points of the electrically conductive strip, the two electrically conductive strips are made to share a single contact point 22*a*1, on one side, but are individually provided with their own contact points 22*a*2 and 22*a*3, on the other side. Obviously, each electrically conductive strip may be provided with its own contact 22*a*1. However, such an arrangement increases the number of contact points, and therefore, increases cost while degrading assembly quality.

The operation for opening the toner sealing member in this embodiment is virtually the same as those in the first and second embodiments. That is, as the opening of the sealing member progresses, the toner sealing member opening completion signaling portion 22*b* is severed at almost the same time as the developer discharge opening is entirely exposed. As a result, the electrical current flowing between the contact points 22*a*1 and 22*a*2 is interrupted, signaling the completion of the opening of the toner sealing member, when the toner sealing member opening operation is stopped.

Figure 10:
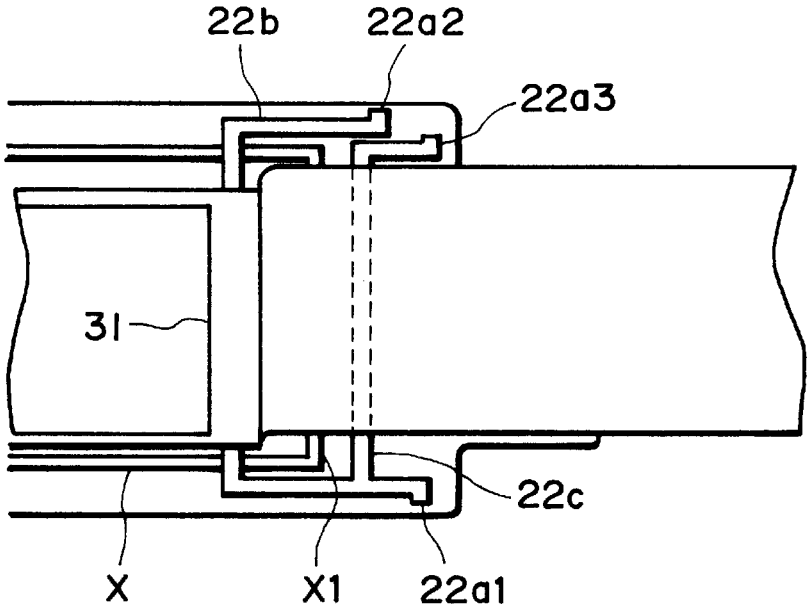
FIG. 10 is an enlarged view of the essential portion of the sealing member in the third embodiment, immediately after the completion of the removal of the sealing member.

Referring to FIG. 10, immediately after the completion of the opening of the sealing member ends, the opening completion signaling electrically conductive strip 22*b* has been severed, but the installation signaling electrically conductive strip 22*c* is still intact, and therefore, the electrical contact points 22*a*1 and 22*a*3 are electrically connected.

Figure 11:
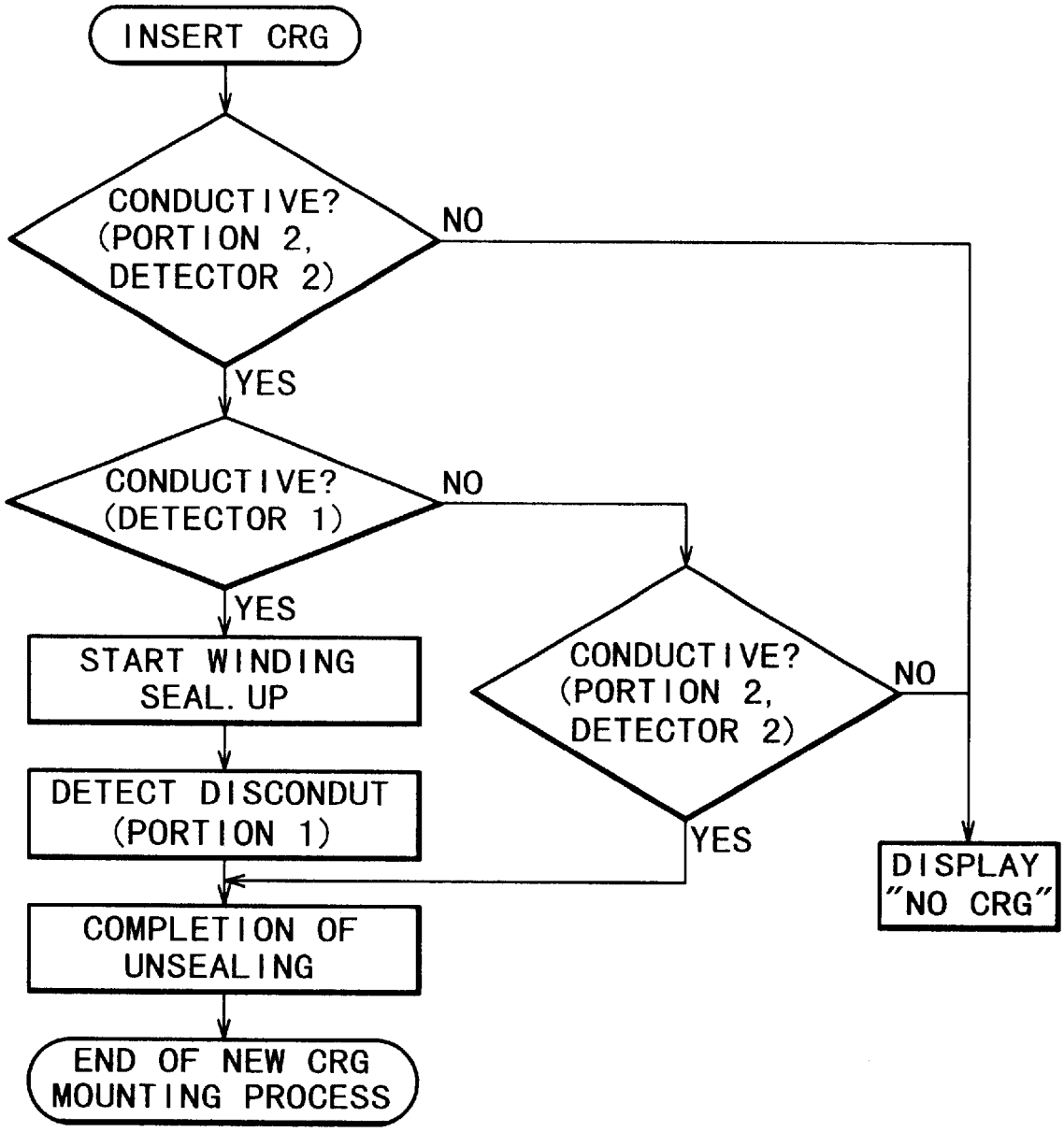
FIG. 11 is a flow chart for the third embodiment.
Figure 12:
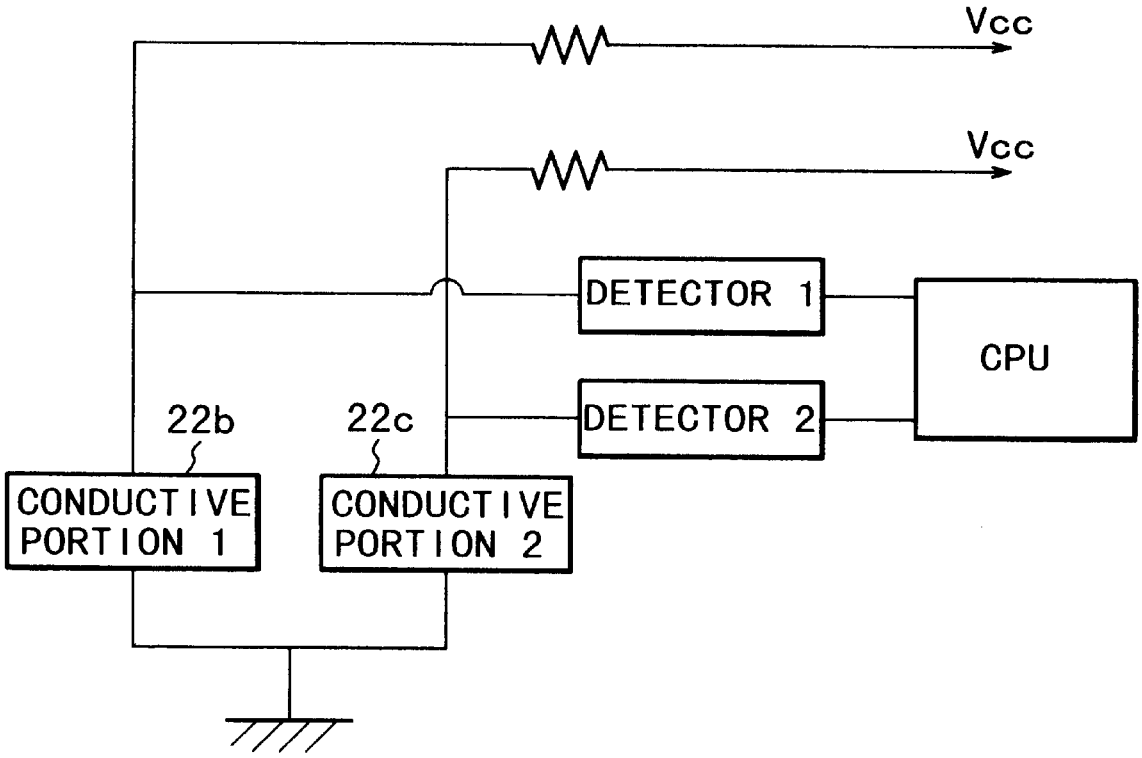
FIG. 12 is a simplified version of the circuit diagram for the third embodiment.

The above described operational steps can be summarized in the form of a flow chart in FIG. 11. FIG. 12 is a simplified version of the detection circuit diagram. Immediately after the installation of the replenishment toner container into the image forming apparatus main assembly, it is detected by the detecting portion 2 of the apparatus main assembly whether or not the electrical current is allowed to flow through the installation signaling electrically conductive strip 22*c* (electrically conductive portion 2). If no current flow is detected, the display of the apparatus main assembly displays information indicating that no developer container is in the image forming apparatus main assembly. If a current flow is detected, it is confirmed by the detecting portion 1 of the apparatus main assembly whether or not there is a current flow through the opening completion signaling electrically conductive strip 22*b* (electrically conductive portion 1). If no current flow is detected, it is confirmed again whether or not there is current flow through the electrically conductive portion 2. Then, if no current flow is detected, the message that no toner container is present is displayed by the image forming apparatus main assembly as described above, whereas if electrical current is detected, it is determined that the toner sealing member has been completely opened. If there is electrical current through the electrically conductive portion 1, the winding of the toner sealing member is started. Then, the moment the severing of the electrically conductive portion 1 by the progress of the winding of the toner sealing member is detected, it is determined that the opening of the toner sealing member has been completed. As for the detecting portions 1 and 2, the same detecting portions as those of the detecting means 35 illustrated in FIG. 3 may be employed.

Referring to FIG. 10, a referential character X designates the portion of the developer container to which the toner sealing member is thermally welded, and a referential character X1 designates a portion of the portion X, at the downstream end in terms of the direction in which the toner sealing member is opened. Positioning the opening completion signaling portion and installation completion signaling portion so that the portion X1 comes between the two signaling portions as illustrated in FIG. 10 makes it possible to stop pulling the toner sealing member past the portion X1, to which the toner sealing member is adhered. Therefore, the amount of force necessary to open the toner sealing member can be reduced.

The installation completion signaling electrically conductive strip is a strip which enables the image forming apparatus main assembly to detect whether or not the developer container itself, or the developing apparatus or process cartridge which integrally comprises the developer container, has been correctly installed in the installation space in the image forming apparatus main assembly.

While the invention has been described with reference to the structures disclosed herein, it is not confined to the details set forth, and this application is intended to cover such modifications or changes as may come within the purposes of the improvements or the scope of the following claims.

What is claimed is:

1. A developer accommodating container for accommodating a developer, said developer accommodating container being detachably mountable to a main assembly of an image forming apparatus comprising:

a main body for accommodating the developer, having an opening for supplying the developer;

an unsealable seal member for sealing said opening; and drive transmitting means for transmitting a first driving force from the main assembly of the apparatus to apply a force for unsealing said seal member, wherein said drive transmitting means starts, after completion of an unsealing operation for said seal member, to transmit a second driving force to a movable member that is movable and in contact with the developer.

2. A container according to claim 1, wherein said developer accommodating container has said movable member in said main body of said container.

3. A container according to claim 1 or 2, wherein said developer accommodating container has a winding-up member for winding said seal member up to unseal said seal member, and said winding-up member receives said first driving force through said drive transmitting means.

4. A container according to claim 1 or 2, wherein said movable member includes a stirring member for stirring the developer.

5. A container according to claim 1 or 2, wherein said developer accommodating container is provided with a portion to be detected for detection of the completion of the unsealing operation by the main assembly of the apparatus.

6. A container according to claim 5, wherein the portion to be detected is provided with a first electroconductive portion which is disconnectable by the unsealing operation, and the main assembly of said apparatus detects an electroconductivity state of the disconnectable first elctroconductive portion to effect said detection of the completion of the unsealing operation.

7. A container according to claim 6, wherein said seal member is provided with a second electroconductive portion for detecting whether said developer accommodating container is mounted to a predetermined position of the main assembly of said apparatus.

8. A container according to claim 7, wherein said second electroconductive portion is provided downstream of said disconnectable first electroconductive portion with respect to a direction in which said seal member is unsealed.

9. A container according to claim 1 or 2, wherein said drive transmitting means is provided with a coupling member for receiving said first and second driving forces from the main assembly of the apparatus.

10. A container according to claim 1 or 2, wherein said drive transmitting means is provided with switching means for switching drive transmission of the driving forces from said seal member to said movable member after completion of the unsealing operation.

11. A developing device for developing an electrostatic image formed on an image bearing member with a developer, said developing device being detachably mountable to a main assembly of an image forming apparatus, said developing device comprising:

a developing container provided with a developer carrying, member for carrying a developer to a position where the electrostatic image is developed with the developer;

a developer accommodating container for accommodating the developer, wherein an opening is provided between said developer accommodating container and said developing container to permit supply of the developer from said developer accommodating container to said developing container;

a seal member for sealing said opening;

drive transmitting means for transmitting a first driving force from the main assembly of the apparatus to apply a force for unsealing said seal member; and a movable member movable and in contact with the developer, wherein said drive transmitting means starts, after completion of an unsealing operation for said sealing member, to transmit a second driving force to said movable member.

12. A developing device according to claim 11, wherein said developing device has a winding-up member for winding said seal member up to unseal said seal member, and said winding-up member receives said first driving force through said drive transmitting means.

13. A developing device according to claim 11, wherein said movable member includes a stirring member for stirring the developer.

14. A developing device according to claim 11, wherein said developing device is provided with a portion to be detected for detection of completion of the unsealing operation by the main assembly of the apparatus.

15. A developing device according to claim 14, wherein the portion to be detected is provided with a first electroconductive portion which is disconnectable by the unsealing operation, and the main assembly of said apparatus detects an electroconductivity state of the disconnectable first electroconductive portion to effect said detection of the completion of the unsealing operation.

16. A developing device according to claim 15, wherein said seal member is provided with a second electroconductive portion for detecting whether said developer accommodating container is mounted to a predetermined position of the main assembly of said apparatus.

17. A developing device according to claim 16, wherein said second electroconductive portion is provided downstream of said disconnectable first electroconductive portion with respect to a direction in which said seal member is unsealed.

18. A developing device according to claim 11, wherein said drive transmitting means is provided with a coupling member for receiving a driving force from the main assembly of the apparatus.

19. A developing device according to claim 11, wherein said image bearing member is a photosensitive member.

20. A developing device according to claim 11, wherein said drive transmitting means is provided with switching means for switching drive transmission of the driving forces from said seal member to said movable member after completion of the unsealing operation.

21. A process cartridge detachably mountable to a main assembly of an image forming apparatus, comprising:

a developing device for developing an electrostatic image formed on an image bearing member with a developer, said developing device being provided with a developing container having a developer carrying member for carrying the developer to a developing position where the electrostatic latent image is developed with the developer and a developer accommodating container for accommodating the developer, and wherein an opening is provided between said developer accommodating container and said developing container to permit supply of the developer from said developer accommodating container to said developing container;

a seal member for sealing said opening;

drive transmitting means for transmitting a first driving force from the main assembly of the apparatus to apply a force for unsealing said seal member; and a movable member which is movable and in contact with the developer, wherein said drive transmitting means starts to transmit a second driving force after completion of an unsealing operation for said seal member.

22. A process cartridge according to claim 21, wherein said developing device has a winding-up member for winding said seal member up to unseal said seal member, and said winding-up member receives the first driving force through said drive transmitting means.

23. A process cartridge according to claim 21, wherein said movable member includes a stirring member for stirring the developer.

24. A process cartridge according to claim 21, wherein said developing device is provided with a portion to be detected for detection of the completion of the unsealing operation by the main assembly of the apparatus.

25. A process cartridge according to claim 24, wherein the portion to be detected is provided with a first electroconductive portion which is disconnectable by the unsealing operation, and the main assembly of said apparatus detects an electroconductivity state of the disconnectable first electroconductive portion to effect said detection of the completion of the unsealing operation.

26. A process cartridge according to claim 25, wherein said seal member is provided with a second electroconductive portion for detecting whether said developer accommodating container is mounted to a predetermined position of the main assembly of said apparatus.

27. A process cartridge according to claim 26, wherein said second electroconductive portion is provided downstream of said disconnectable first electroconductive portion with respect to a direction in which said seal member is unsealed.

28. A process cartridge according to claim 21, wherein said drive transmitting means is provided with a coupling member for receiving the first and second driving forces from the main assembly of the apparatus.

29. A process cartridge according to claim 21, wherein said image bearing member is a photosensitive member.

30. A process cartridge according to claim 1, wherein said drive transmitting means is provided with switching means for switching the drive transmission from said seal member to said movable member after completion of the unsealing operation.

31. An image forming apparatus, comprising:

a mounting portion for detachably mounting a developer accommodating container for accommodating a developer to a main assembly of the apparatus, said developer accommodating container including a main body for accommodating the developer, having an opening for supplying the developer; an unsealable seal member for sealing said opening; drive transmitting means for transmitting a first driving force from the main assembly of the apparatus to apply a force for unsealing said seal member; and a movable member movable and in contact with the developer; and driving means for transmitting the first driving force to said drive transmitting means, wherein said drive transmitting means starts to transmit a second driving force to said movable member after completion of an unsealing operation for said seal member.

32. An image forming apparatus according to claim 31, wherein said developer accommodating container has a winding-up member for winding said seal member up to unseal said seal member, and said winding-up member receives the first driving force through said drive transmitting means.

33. An image forming apparatus according to claim 31, wherein said movable member includes a stirring member for stirring the developer.

34. An image forming apparatus according to claim 31, further comprising a detecting portion for detecting the completion of the unsealing operation by the main assembly of the apparatus.

35. An image forming apparatus according to claim 34, wherein said seal member is provided with a first electroconductive portion to be detected which is disconnectable by the unsealing operation, and said detecting portion detects an electroconductivity state of the disconnectable first electroconductive portion to effect said detection of the completion of the unsealing operation.

36. An image forming apparatus according to claim 35, wherein said seal member is provided with a second electroconductive portion for permitting said main assembly to detect whether said developer accommodating container is mounted to said mounting portion of the main assembly of said apparatus.

37. An image forming apparatus according to claim 36, wherein said second electroconductive portion is provided downstream of said disconnectable first electroconductive portion with respect to a direction in which said seal member is unsealed.

38. An image forming apparatus according to claim 31, further comprising a coupling member for receiving the first and second driving forces from the main assembly of the apparatus.

39. An image forming apparatus according to claim 31, further comprising a photosensitive member.

40. An image forming apparatus according to claim 31, wherein said drive transmitting, means is provided with switching means for switching the drive transmission from said seal member to said movable member after completion of the unsealing operation.

41. A developer accommodating container for accommodating a developer, said developer accommodating container being detachably mountable to a main assembly of an image forming apparatus comprising:

a main body for accommodating the developer, having an opening or supplying the developer;

an unsealable seal member for sealing said opening;

first drive transmitting means for transmitting a first driving force from the main assembly of the apparatus through a first drive transmission path to apply a force for unsealing said seal member;

second drive transmitting means for transmitting a second driving force from the main assembly of the apparatus through a second drive transmission path to apply a force for driving a movable member that is movable and in contact with the developer; and a force receiving portion for receiving a force for selecting either one of a drive transmission through said first drive transmitting means and a drive transmission through said second drive transmitting means.

42. A container according to claim 41, wherein said developer accommodating container has said movable member in said main body of said container.

43. A container according to claim 41 or 42, wherein said developer accommodating container has a winding-up member for winding said seal member up to unseal said seal member, and said winding-up member receives said first driving force through said first drive transmitting means.

44. A container according to claim 41 or 42, wherein said movable member includes a stirring member for stirring the developer.

45. A container according to claim 41 or 42, wherein said developer accommodating container is provided with a coupling member for receiving said first and second driving forces from the main assembly of the apparatus.

46. A container according to claim 41, wherein said force receiving portion is a part of a rotatable member, and the force for the selection is provided by changing a rotational direction of the rotatable member.

47. A container according to claim 46, wherein said rotatable member is swingable by changing the rotational direction of said rotatable member.

48. A developing device for developing an electrostatic image formed on an image bearing member with a developer, said developing device being detachably mountable to a main assembly of an image forming apparatus, said developing device comprising:

a developing container provided with a developer carrying member for carrying a developer to a position where said electrostatic image is developed with the developer;

a developer accommodating container for accommodating the developer, wherein an opening is provided between said developer accommodating container and said developing container to permit supply of the developer from said developer accommodating container to said developing container;

a seal member for sealing said opening;

first drive transmitting means for transmitting a first driving force from the main assembly of the apparatus through a first drive transmission path to apply a force for unsealing said seal member;

a movable member movable and in contact with the developer;

second drive transmitting means for transmitting a second driving force from the main assembly of the apparatus through a second drive transmission path to apply a force for driving said movable member; and a force receiving portion for receiving a force for selecting either one of a drive transmission through said first drive transmitting means and a drive transmission through said second drive transmitting means.

49. A developing device according to claim 48, wherein said developing device has a winding-up member for winding said seal member up to unseal said seal member, and said winding-up member receives said first driving force through said first drive transmitting means.

50. A developing device according to claim 48, wherein said movable member includes a stirring member for stirring the developer.

51. A developing device according to claim 48, wherein said developing device is provided with a coupling member for receiving the first and second driving forces from the main assembly of the apparatus.

52. A developing device according to claim 48, wherein said force receiving portion is a part of a rotatable member, and the force for the selection is provided by changing a rotational direction of the rotatable member.

53. A developing device according to claim 52, wherein said rotatable member is swingable by changing the rotational direction of said rotatable member.

54. A process cartridge detachably mountable to a main assembly of an image forming apparatus, comprising:

a developing device for developing an electrostatic image formed on the image bearing member with a developer, said developing device being provided with a developing container having a developer carrying member for carrying the developer to a developing position where the electrostatic latent image is developed with the developer and a developer accommodating container for accommodating the developer, and wherein an opening is provided between said developer accommodating container and said developing container to permit supply of the developer from said developer accommodating container to said developing container;

a seal member for sealing said opening;

first drive transmitting means for transmitting a first driving force from the main assembly of the apparatus to apply a force for unsealing said seal member; and a movable member which is movable and in contact with the developer, second drive transmitting means for transmitting a second driving force from the main assembly of the apparatus through a second drive transmission path to apply a force for driving said movable member; and a force receiving portion for receiving a force for selecting either one of a drive transmission through said first drive transmitting means and a drive transmission through said second drive transmitting means.

55. A process cartridge according to claim 54, wherein said process cartridge has a winding-up member for winding said seal member up to unseal said seal member, and said winding-up member receives the first driving force through said first drive transmitting means.

56. A process cartridge according to claim 54, wherein said movable member includes a stirring member for stirring the developer.

57. A process cartridge according to claim 54, wherein said process cartridge is provided with a coupling member for receiving the first and second driving forces from the main assembly of the apparatus.

58. A process cartridge according to claim 54, wherein said image bearing member is a photosensitive member.

59. A process cartridge according to claim 54, wherein said force receiving portion is a part of a rotatable member, and the force for the selection is provided by changing a rotational direction of the rotatable member.

60. A process cartridge according to claim 59, wherein said rotatable member is swingable by changing the rotational direction of said rotatable member.

* * * * *

UNITED STATES PATENT AND TRADEMARK OFFICE

CERTIFICATE OF CORRECTION

PATENT NO. : 6,512,903 B2
DATED : January 28, 2003
INVENTOR(S) : Kazuo Chadani

It is certified that error appears in the above-identified patent and that said Letters Patent is hereby corrected as shown below:

Column 9,
Line 62, “carrying,” should read -- carrying --.

Column 12,
Line 38, “transmitting,” should read -- transmitting --.
Line 47, “or” should read -- for --.

Signed and Sealed this

Eighteenth Day of November, 2003

JAMES E. ROGAN
*Director of the United States Patent and Trademark Office*